US006932663B2

(12) United States Patent
Matsuda

(10) Patent No.: US 6,932,663 B2
(45) Date of Patent: Aug. 23, 2005

(54) PERSONAL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/739,934

(22) Filed: Dec. 17, 2003

(65) Prior Publication Data

US 2004/0147183 A1 Jul. 29, 2004

(30) Foreign Application Priority Data

Dec. 20, 2002 (JP) ..... 2002-369265

(51) Int. Cl.[7] ..... B63H 21/38
(52) U.S. Cl. ..... 440/88 F
(58) Field of Search ..... 440/88 C, 88 D, 440/88 F, 88 G, 88 M, 88 R; 123/41.08, 516, 579

(56) References Cited

U.S. PATENT DOCUMENTS 3,358,654 A * 12/1967 Shanahan et al. ..... 123/41.08
4,133,284 A * 1/1979 Holcroft ..... 440/88 R
5,902,158 A * 5/1999 Nakase et al. ..... 440/88 R
5,937,802 A * 8/1999 Bethel et al. ..... 123/41.08
6,015,321 A * 1/2000 Ozawa et al. ..... 440/88 R
6,123,592 A * 9/2000 Ozawa ..... 440/88 F
6,454,621 B2 * 9/2002 Matsuda ..... 440/88 R

* cited by examiner

*Primary Examiner*—Lars A. Olson
(74) *Attorney, Agent, or Firm*—Alleman Hall McCoy Russell & Tuttle LLP

(57) ABSTRACT

A personal watercraft typically comprises an engine having a plurality of fuel injectors arranged along a longitudinal direction of the watercraft, a fuel tank configured to store fuel and to have an outlet port from which the fuel outflows out and a return port through which the fuel is returned to the fuel tank, and a fuel distribution pipe provided between the outlet port and the return port of the fuel tank and configured to distribute the fuel outflowing from the fuel tank to a plurality of fuel injectors connected to the fuel distribution pipe at positions thereof and to return remaining fuel to the fuel tank, wherein the fuel distribution pipe is configured to extend such that an upstream portion is located lower than a downstream portion in a flow passage of the fuel flowing within the fuel distribution pipe.

10 Claims, 3 Drawing Sheets

PERSONAL WATERCRAFT

BACKGROUND OF THE INVENTION

1. Field of the Invention

The present invention relates to a personal watercraft. More particularly, the present invention relates to a construction of a fuel supply passage configured to supply a fuel to an engine of the personal watercraft.

2. Description of the Related Art

In recent years, jet-propulsion personal watercraft have been widely used in leisure, sport, rescue activities, and the like. A typical personal watercraft includes an engine mounted substantially at a center position in a longitudinal direction within a body surrounded by a hull and a deck. The personal watercraft is equipped with a water jet pump behind the engine and a fuel tank forward of the engine. The engine drives the water jet pump, which pressurizes and accelerates water sucked from a water intake generally provided on a bottom surface of the hull and ejects it rearward from an outlet port. Thereby, the personal watercraft is propelled.

The engine mounted in the personal watercraft typically includes multiple cylinders that are arranged along the longitudinal direction of the watercraft (e.g., in-line multi-cylinder engine, and a V-type multi-cylinder engine). The engine is provided with fuel injectors such as electronically controlled fuel injectors respectively provided for the cylinders to inject a predetermined amount of fuel into air-intake passages or into a combustion chamber. The fuel tank has an outlet from which a fuel outflows and a return port through which some of the fuel is returned. The fuel stored within the fuel tank is delivered from the outlet to a fuel distribution pipe. The fuel distribution pipe extends along the longitudinal direction of the watercraft, and the fuel injectors are connected to a side portion of the fuel distribution pipe. Therefore, some of the fuel flowing within the fuel distribution pipe is distributed to the fuel injectors and the remaining fuel is returned to the fuel tank through the return port.

As described above, the fuel tank is placed forward of the engine. The outlet of the fuel tank is typically connected to a front portion of the fuel distribution pipe which is close to the outlet, and the return port is connected to a rear portion of the fuel distribution pipe. Therefore, the fuel outflowing from the fuel tank flows from the front portion (upstream portion) to the rear portion (downstream portion) within the fuel distribution pipe, and is distributed to the fuel injectors at positions of the fuel distribution pipe.

The engine tends to heat up to a high temperature during operation, and it takes some time for the engine to sufficiently decrease the temperature after the engine stops. Therefore, after the engine stops, some of the fuel remaining within the fuel distribution pipe is vaporized. Since the personal watercraft is constructed such that its center of gravity is located slightly rearward of the center position in the longitudinal direction, a fore part of the body is located higher than an aft part of the body when the watercraft is at rest on the water without a rider. When the rider rides on the watercraft and starts up the engine, the fore part is located higher than the fore part of the watercraft without the rider. In this construction, the vaporized fuel within the fuel distribution pipe tends to remain within the front portion of the fuel distribution pipe (on the upstream portion in a flow passage of the fuel) due to a buoyant force, when the watercraft is at rest on the water and the engine is starting up.

However, the vaporized fuel remaining within the front portion of the fuel distribution pipe while the watercraft is at rest on the water is guided from the front portion to the rear portion within the fuel distribution pipe, together with a liquefied fuel (hereinafter referred to as liquid fuel), when the engine starts up next. As a result, the vaporized fuel is mixed with the liquid fuel being distributed from the fuel distribution pipe to the fuel injectors. Under this condition, the fuel injectors cannot inject the liquid fuel in appropriate amount, thereby making it difficult for the engine to operate stably during start-up.

SUMMARY OF THE INVENTION

The present invention addresses the above described condition, and an object of the present invention is to provide a personal watercraft capable of inhibiting an unstable operation of the engine due to a vaporized fuel during start-up of an engine.

According to the present invention, there is provided a personal watercraft comprising an engine having a plurality of fuel injectors arranged along a longitudinal direction of the watercraft, a fuel tank configured to store a fuel supplied to the engine and to have an outlet from which the fuel outflows and a return port through which the fuel is returned to the fuel tank, and a fuel distribution pipe provided between the outlet and the return port of the fuel tank and configured to distribute the fuel outflowing from the outlet of the fuel tank to a plurality of fuel injectors connected to the fuel distribution pipe at positions thereof and to return a remaining fuel to the fuel tank through the return port, wherein the fuel distribution pipe is configured to extend such that an upstream portion thereof is located lower than a downstream portion thereof in a flow passage of the fuel flowing within the fuel distribution pipe.

In such a construction, while the engine is in a stopped state, the vaporized fuel remains within the downstream portion of the fuel distribution pipe. Upon start-up of the engine, the vaporized fuel is not supplied to the fuel injectors, but directly returned to the fuel tank together with a liquid fuel. As s result, the engine can start up stably.

The fuel distribution pipe may be configured to extend such that the downstream portion is located forward of the upstream portion in the longitudinal direction of the watercraft.

In such a construction, while the engine is in a stopped state, the fuel distribution pipe provided substantially horizontally is inclined such that a front end portion thereof is located higher than a rear end portion thereof as in a body of the watercraft. Therefore, the vaporized fuel remains within the front portion of the fuel distribution pipe, i.e., the downstream portion in the flow passage of the fuel. Upon start-up of the engine, the vaporized fuel remaining within the front portion of the fuel distribution pipe is not supplied to the fuel injectors but returned to the fuel tank together with the liquid fuel. As a result, the engine can start up stably.

The fuel tank may be placed forward of the engine in the longitudinal direction of the watercraft. In this case, the length of a pipe through which the fuel is returned to the fuel tank can be reduced, which makes it easy for the vaporized fuel to be returned to the fuel tank.

The personal watercraft may further comprise an open-looped cooling system configured to cool the engine using water outside the watercraft as cooling water. The cooling system is configured to draw some of the water pressurized by the water jet pump for use as cooling water to cool engine components and supply the cooling water to the engine through a cooling water pipe. The open-looped cooling system is typically employed in the personal watercraft.

In the personal watercraft equipped with the open-looped cooling system so constructed, when the engine stops, the water jet pump stops supplying the water, and the cooling water within the cooling water pipe is discharged outside the watercraft. Under this condition, it takes a relatively long time for the engine to sufficiently cool down to a low temperature after the engine stops, thereby causing the fuel within the fuel distribution pipe to be vaporized. Therefore, in the above described construction of the fuel distribution pipe, the fuel tank, and the like is suitable for use in the personal watercraft which is equipped with the open-looped cooling system and requires a relatively long time to cool down after the engine stops. With this construction, the engine can operate stably during start-up.

The fuel distribution pipe may be located higher than an upper end of the fuel tank. In a construction in which the fuel distribution pipe is located lower than the fuel tank, the vaporized fuel within the fuel distribution pipe flows into the fuel tank by a buoyant force. On the other hand, in the construction in which the fuel distribution pipe is located higher than the upper end of the fuel tank, the vaporized fuel tends to remain within the fuel distribution pipe without moving toward the fuel tank. Therefore, the construction in which the outlet of the fuel tank is connected to the rear portion of the fuel distribution pipe and the return port of the fuel tank is connected to the front portion of the fuel distribution pipe, is suitable for use in the personal watercraft in which the fuel distribution pipe is located higher than the upper end of the fuel tank. With this construction, the vaporized fuel within the fuel distribution pipe is inhibited from being supplied to the fuel injectors during start-up of the engine.

The above and further objects and features of the invention will more fully be apparent from the following detailed description with accompanying drawings.

DETAILED DESCRIPTION OF THE PREFERRED EMBODIMENTS

Figure 1:
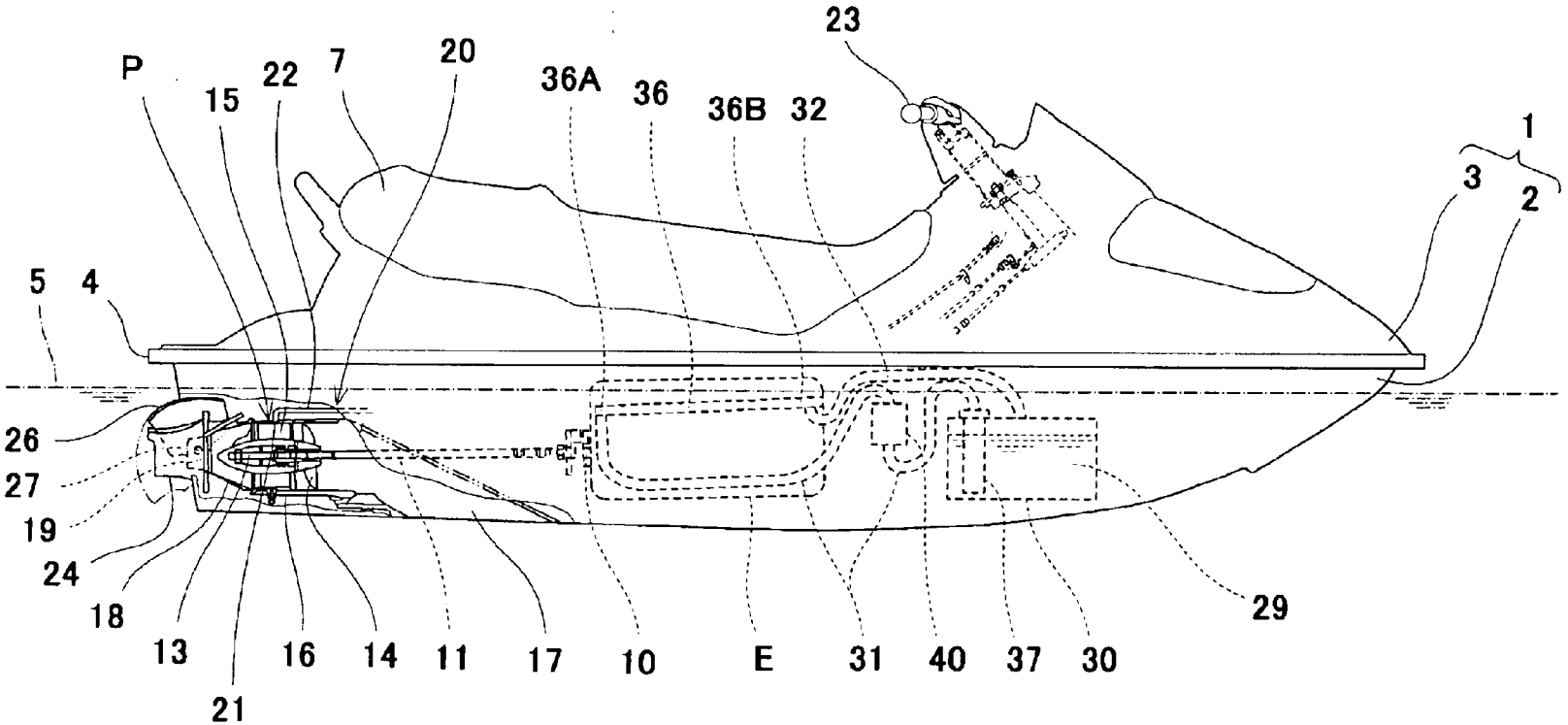
FIG. 1 is a side view of a personal watercraft according to an embodiment of the present invention.

Hereinafter, an embodiment of a personal watercraft of the present invention will be described with reference to the accompanying drawings. The personal watercraft in FIG. 1 is a straddle-type personal watercraft provided with a seat 7 straddled by a rider. A body 1 of the watercraft comprises a hull 2 and a deck 3 covering the hull 2 from above. A line at which the hull 2 and the deck 3 are connected over the entire perimeter thereof is called a gunnel line 4. The gunnel line 4 is located above a waterline 5 when the watercraft is at rest on water.

The personal watercraft in FIG. 1 is constructed such that the gunnel line 4 is substantially parallel to the waterline 5 when the watercraft is at rest on the water without a rider. Some watercraft rest on the water with a body 1 inclined such that a fore part of the gunnel line 4 is located higher than an aft part of the gunnel line 4. The embodiment described below is applicable to such a personal watercraft. In the personal watercraft in FIG. 1, the body 1 is inclined such that the fore part is located higher than the aft part when the rider rides on the watercraft.

Figure 2:
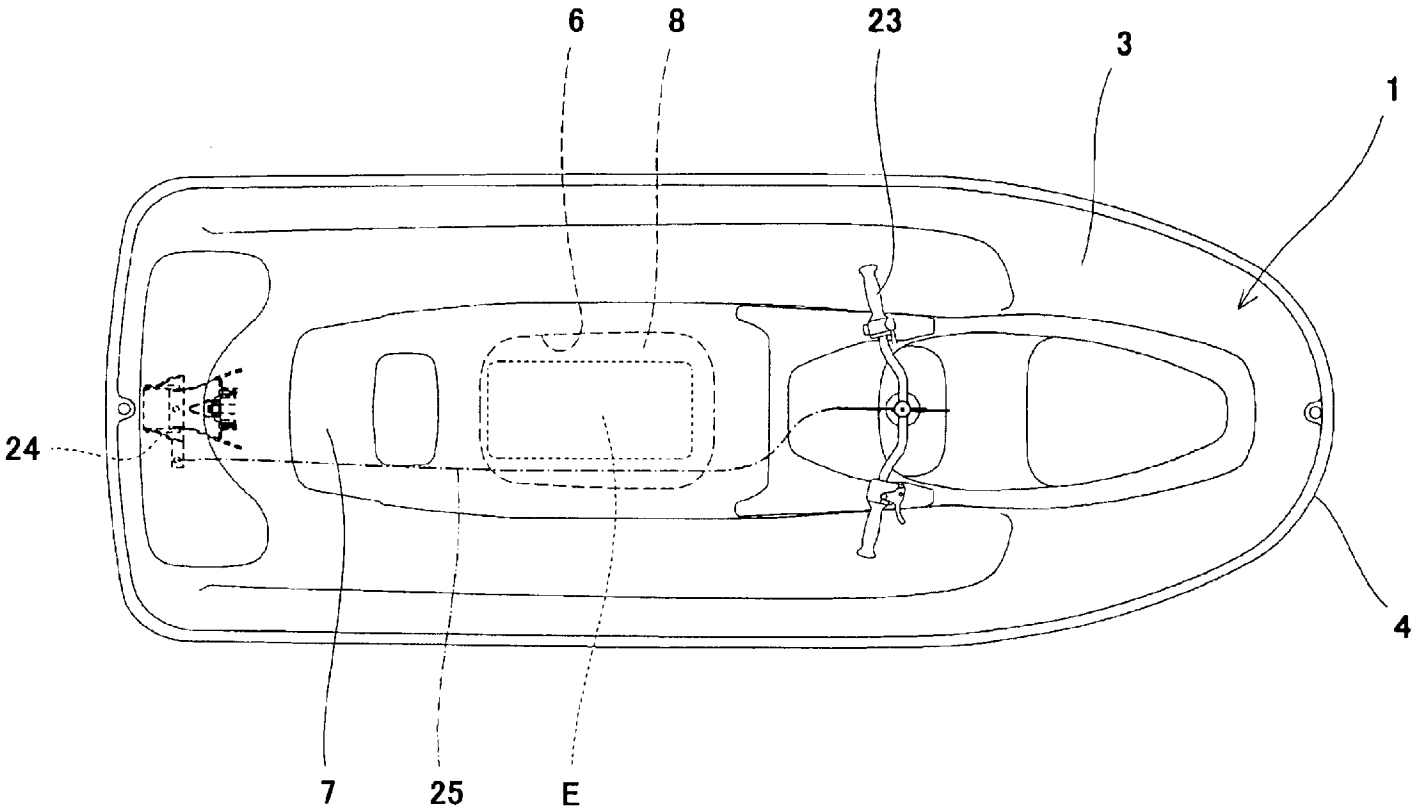
FIG. 2 is a plan view of the personal watercraft in FIG. 1.

As shown in FIG. 2, an opening 6, which has a substantially rectangular shape as seen from above is formed at a substantially center section of the deck 3 in the upper portion of the body 1 such that its longitudinal direction corresponds with the longitudinal direction of the body 1. The seat 7 is removably mounted over the opening 6.

An engine room 8 is provided in a space defined by the hull 2 and the deck 3 below the opening 6. An engine E is mounted within the engine room 8 and configured to drive a water jet pump P that propels the watercraft. The engine room 8 has a convex-shaped transverse cross-section and is configured such that its upper portion is smaller than its lower portion. In this embodiment, the engine E is an in-line four-cylinder four-cycle engine.

As shown in FIG. 1, the engine E is mounted such that a crankshaft 10 extends along the longitudinal direction of the body 1. An output end of the crankshaft 10 is rotatably coupled integrally with a pump shaft 13 of the water jet pump P provided on the rear side of the body 1 through a propeller shaft 11. An impeller 14 is attached to the pump shaft 13 of the water jet pump P. Fairing vanes 15 are provided behind the impeller 14. The impeller 14 is covered with a pump casing 16 on the outer periphery thereof.

A water intake 17 is provided on the bottom of the body 1. The water intake 17 is connected to the pump casing 16 through a water passage. The pump casing 16 is connected to a pump nozzle 18 provided on the rear side of the body 1. The pump nozzle 18 has a cross-sectional area that gradually reduces rearward, and an outlet port 19 is provided on the rear end of the pump nozzle 18.

The water outside the watercraft is sucked from the water intake 17 and fed to the water jet pump P. The water jet pump P pressurizes and accelerates the water and the fairing vanes 15 guide water flow behind the impeller 14. The water is ejected through the pump nozzle 18 and from the outlet port 19 and, as the resulting reaction, the watercraft obtains a propulsion force.

The personal watercraft according to this embodiment comprises an open-looped cooling system 20. As shown in FIG. 1, the cooling system 20 is provided with a water-drawing port 21 provided on an upper portion of the pump casing 16 and a cooling water pipe 22 extending from the water-drawing port 21 to the engine E. And, the cooling system 20 is configured to draw some of the water pressurized by the water jet pump P through the water-drawing port 21 for use as cooling water to cool engine components and supply the cooling water to the engine E through the cooling water pipe 22. The cooling water cools the components of the engine E.

A bar-type steering handle 23 is provided on a front portion of the deck 3. The handle 23 is connected to a steering nozzle 24 provided behind the pump nozzle 18 through a cable 25 in FIG. 2. When the rider rotates the handle 23 clockwise or counterclockwise, the steering nozzle 24 is swung toward the opposite direction so that the ejection direction of the water being ejected through the pump nozzle 18 can be changed, and the watercraft can be correspondingly turned to any desired direction while the water jet pump P is generating the propulsion force.

As shown in FIG. 1, a bowl-shaped reverse deflector 26 is provided on the rear side of the body 1 and on an upper portion of the steering nozzle 24 such that it can vertically swing around a horizontally mounted swinging shaft 27. When the deflector 26 is swung downward to a lower position around the swinging shaft 27 so as to be located behind the steering nozzle 24, the water being ejected rearward from the steering nozzle 24 is ejected substantially forward. As the resulting reaction, the personal watercraft moves rearward.

As shown in FIG. 1, a fuel tank 30 is mounted within the body 1 to be located forward of the engine E. Within the fuel tank 30, a fuel 29 to be combusted in the engine E is stored. The fuel 29 stored within the fuel tank 30 is supplied to the engine E through a supply pipe 31, and some of the fuel is combusted in the engine E. The remaining fuel is returned to the fuel tank 30 through a return pipe 32. How the fuel is delivered from the fuel tank 30 to the engine E through the supply pipe 31 will be described in detail later.

Figure 3:
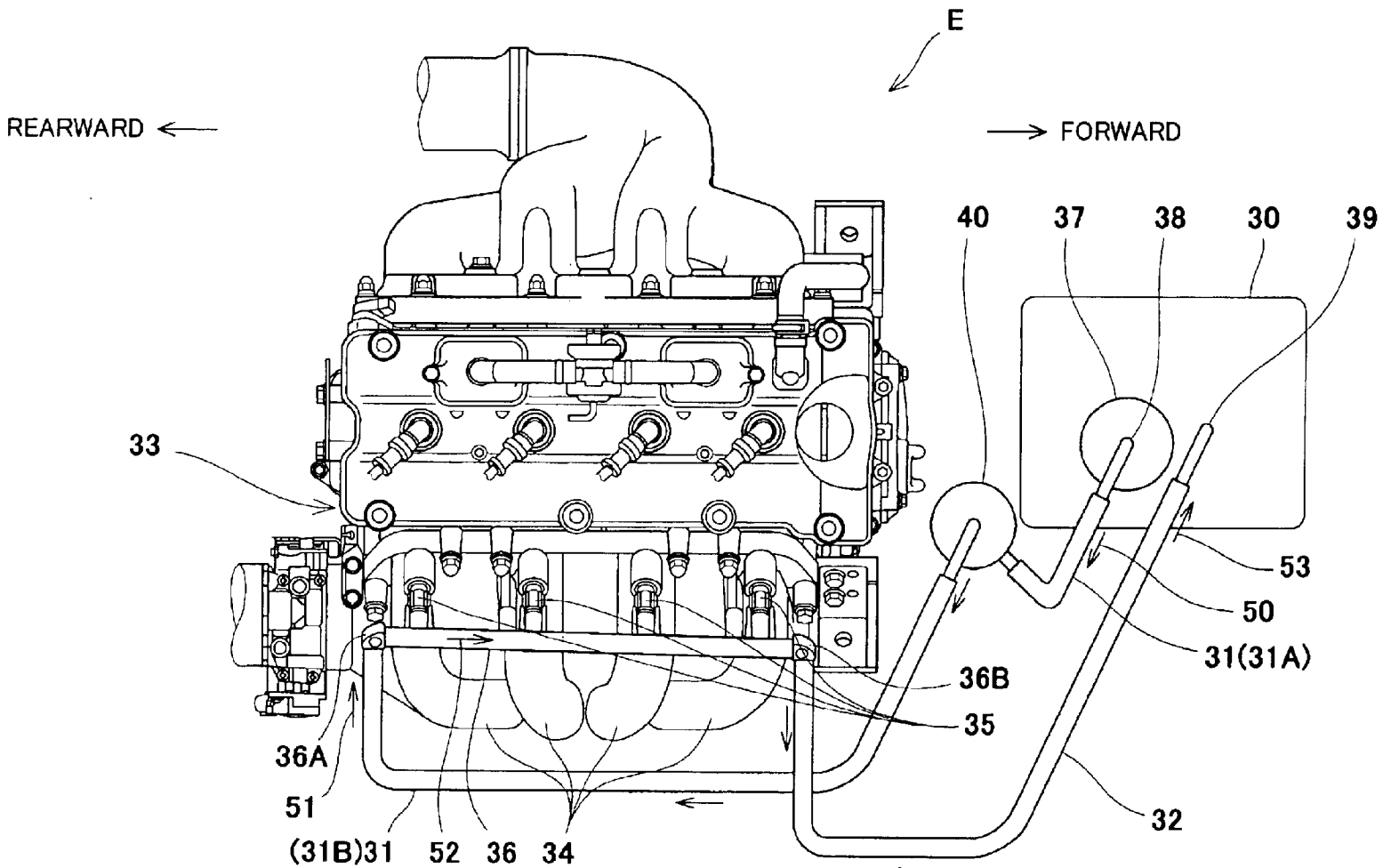
FIG. 3 is a partial plan view showing a construction of an engine, a fuel tank and a fuel distribution pipe in the personal watercraft in FIG. 1.

As shown in FIG. 3, air-intake pipes 34 are connected to a side portion of the cylinder head 33 in an upper portion of the engine E so as to correspond to four cylinders arranged in the longitudinal direction of the body 1. The air-intake pipes 34 are respectively provided with fuel injectors 35, each configured to inject a fuel to taken-in air flowing within a corresponding one of the air-intake pipes 34. The fuel injectors 35 are attached at substantially the same positions of the air-intake pipes 34 and arranged to be spaced apart from one another in the longitudinal direction of the body 1.

The fuel injectors 35 are connected to a fuel distribution pipe 36 of a straight-pipe shape. The fuel distribution pipe 36 extends along the longitudinal direction of the body 1 so as to conform to the arrangement of the fuel injectors 35. The fuel injectors 35 are connected to a side portion of the fuel distributor 36. As shown in FIG. 1, the fuel distribution pipe 36 is inclined such that a front end portion 36B is located higher than a rear end portion 36A with respect to the waterline 5. And, the fuel distribution pipe 36 is located higher than an upper end of the fuel tank 30.

Alternatively, the fuel distribution pipe 36 may be inclined such that the front end portion 36B is located higher than the rear end portion 36A with respect to the waterline 5 by mounting the engine E such that a front portion thereof is located higher than a rear portion thereof with respect to the waterline 5. As a further alternative, by constituting the body 1 such that a fore part is located higher than an aft part, the fuel distribution pipe 36 may be inclined such that the front end portion 36B is located higher than the rear end portion 36A with respect to the waterline 5.

Even in a case where the fuel distribution pipe 36 is inclined such that the front end portion 36B is located lower than the rear end portion 36A while the watercraft is at rest on the water without the rider, the fuel distribution pipe 36 may be inclined such that the front end portion 36B is located higher than the rear end portion 36A by inclining the body 1 such that the fore part is located higher than the aft part, when the rider rides on the watercraft and starts up the engine E.

As shown in FIG. 3, the fuel tank 30 is provided with a fuel pump 37. The fuel pump 37 is provided with an outlet port 38 from which the fuel 29 outflows. The fuel tank 30 is provided with a return port 39 through which the fuel 29 is returned to the fuel tank 30. The fuel pump 37 is driven by an operation of the engine E and stops when the engine E stops.

The outlet port 38 of the fuel pump 37 and the rear end portion 36A of the fuel distribution pipe 36 are connected to each other through the supply pipe 31 with a filter 40 provided between the outlet port 38 and the rear end portion 36A to remove substances contained in the fuel 29. The supply pipe 31 is comprised of a first supply pipe 31A configured to connect the outlet port 38 of the fuel pump 37 to the filter 40 and a second supply pipe 31B configured to connect the filter 40 to the rear end portion 36A of the fuel distribution pipe 36. The front end portion 36B of the fuel distribution pipe 36 is connected to the return port 39 of the fuel tank 30 through the return pipe 32.

In the personal watercraft constructed as described above, while the engine E is operating, the fuel 29 stored in the fuel tank 30 is pumped by the fuel pump 37 to outflow from the outlet port 38 to the supply pipe 31 (see arrow 50 in FIG. 3). The fuel 29 is guided through the filter 40 and then guided into the fuel distribution pipe 36 through the rear end portion 36A (see arrow 51 in FIG. 3). Within the fuel distribution pipe 52, the fuel 29 flows from the rear end portion 36A toward the front end portion 36B (see arrow 52 in FIG. 3).

Some of the fuel 29 flowing within the fuel distribution pipe 36 is distributed to the fuel injectors 35 at positions thereof. Each of the fuel injectors 35 injects the fuel 29 into the taken-in air flowing within a corresponding one of the air-intake pipes 34. As a result, the fuel is mixed with the taken-in air and an air-fuel mixture is drawn into the combustion chamber and combusted therein, thereby allowing the engine E to be driven. The remaining fuel is returned from the front end portion 36B to the fuel tank 30 through the return pipe 32 and the return port 39 (see arrow 53) and collected into the fuel 29 reserved within the fuel tank 29.

In the open-looped cooling system 20, the cooling water is discharged outside the body 1 as soon as the engine E stops. The engine E maintains a relatively high-temperature condition for some time after the engine E has stopped, and the heat causes some of the fuel within the fuel distribution pipe 36 to be vaporized. In this case, since the fuel distribution pipe 36 is inclined such that the front end portion 36B is higher than the rear end portion 36A, the vaporized fuel tends to remain in the vicinity of the front end portion 36B. It should be appreciated that, since the fuel distribution pipe 36 is located higher than the upper end of the fuel tank 30, the vaporized fuel is inhibited from flowing toward the fuel tank 30 through the return pipe 32 while the engine E is in a stopped state.

However, when the engine E starts up next, the fuel 29 is pumped by the fuel pump 37 to outflow from the outlet port 38 and then is guided from the rear end portion 36A toward the front end portion 36B within the fuel distribution pipe 36. As a result, the vaporized fuel remaining in the vicinity of the front end portion 36B while the engine E is in the stopped state is pushed out by the fuel flowing within the fuel distribution pipe 36 and is guided from the front end portion 36B to the fuel tank 30 through the return pipe 32. As a matter of course, when the fuel distribution pipe 36 is located lower then the upper end of the fuel tank 30, the vaporized fuel within the fuel distribution pipe 36 is smoothly guided to the fuel tank 30.

Thus, in the personal watercraft constructed as described above, the vaporized fuel remaining within the fuel distribution pipe 36 while the engine E is the stopped state is guided from the front end portion 36B of the fuel distribution pipe 36 to the fuel tank 30 as soon as the engine E starts up, and is not delivered to the fuel injectors 35. Therefore, the fuel injectors 35 can inject the liquid fuel to the taken-in air within the air-intake pipes 34 in predetermined amount, thereby allowing the engine E to stably start up.

The fuel distribution pipe 36 may be formed integrally with the supply pipe 31 and/or the return pipe 32.

As this invention may be embodied in several forms without departing from the spirit of essential characteristics thereof, the above embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft comprising:

a body including a hull and a deck joined to the hull from above;

an engine having a plurality of fuel injectors arranged along a longitudinal direction of the watercraft; and a fuel supply system associated with the engine, the fuel supply system including:

a fuel tank configured to store a fuel supplied to the engine and to have an outlet port from which the fuel outflows and a return port through which the fuel is returned to the fuel tank;

a fuel distribution pipe configured to extend in a direction in which the fuel injectors are arranged along the longitudinal direction of the watercraft, and to be connected to each of the fuel injectors;

a fuel supply pipe fluidically connecting the outlet port of the fuel tank and an upstream end portion of the fuel distribution pipe; and a fuel return pipe fluidically connecting the return port of the fuel tank and a downstream end portion of the fuel distribution pipe;

wherein the fuel distribution pipe is configured to extend such that the upstream end portion thereof is located lower than the downstream end portion thereof in a direction substantially perpendicular to a gunnel line forming a joint portion at which the hull and the deck are jointed to each other while the watercraft is at rest.

2. The personal watercraft according to claim 1, wherein the fuel distribution pipe is configured to extend such that the downstream portion is located forward of the upstream portion in the longitudinal direction of the watercraft.

3. The personal watercraft according to claim 2, wherein the fuel tank is placed forward of the engine in the longitudinal direction of the watercraft.

4. The personal watercraft according to claim 1, further comprising:

an open-looped cooling system configured to cool the engine using water outside the watercraft as cooling water.

5. A personal watercraft comprising:

an engine having a plurality of fuel injectors arranged along a longitudinal direction of the watercraft; and a fuel supply system associated with the engine, the fuel supply system including:

a fuel tank configured to store a fuel supplied to the engine and to have an outlet port from which the fuel outflows and a return port through which the fuel is returned to the fuel tank;

a fuel distribution pipe configured to extend in a direction in which the fuel injectors are arranged along the longitudinal direction of the watercraft, and to be connected to each of the fuel injectors;

a fuel supply pipe fluidically connecting the outlet port of the fuel tank and an upstream end portion of the fuel distribution pipe; and a fuel return pipe fluidically connecting the return port of the fuel tank and a downstream end portion of the fuel distribution pipe;

wherein the fuel distribution pipe is configured to extend such that the upstream end portion thereof is located lower than the downstream end portion thereof and wherein the fuel distribution pipe is configured to be located higher than an upper end of the fuel tank.

6. The personal watercraft according to claim 5, wherein the fuel distribution pipe is formed by a straight pipe and inclined such that the upstream end portion thereof is located lower than the downstream end portion thereof.

7. The personal watercraft according to claim 5, wherein the fuel distribution pipe is configured to extend such that the upstream end portion thereof is located laterally relative to a rear portion of the engine and the downstream end portion thereof is located laterally relative to a front portion of the engine.

8. The personal watercraft according to claim 5, wherein the fuel distribution pipe is configured to extend such that the downstream portion is located forward of the upstream portion in the longitudinal direction of the watercraft.

9. The personal watercraft according to claim 8, wherein the fuel tank is placed forward of the engine in the longitudinal direction of the watercraft.

10. The personal watercraft according to claim 5, further comprising:

an open-looped cooling system configured to cool the engine using water outside the watercraft as cooling water.

* * * * *